US007731039B1

(12) United States Patent
Minger et al.

(10) Patent No.: US 7,731,039 B1
(45) Date of Patent: Jun. 8, 2010

(54) RETAIL DISPLAY

(75) Inventors: Paul Minger, Gurnee, IL (US); Daniel Keippel, Huntley, IL (US)

(73) Assignee: Walgreen Co., Deerfield, IL (US)

( * ) Notice: Subject to any disclaimer, the term of this patent is extended or adjusted under 35 U.S.C. 154(b) by 365 days.

(21) Appl. No.: 11/852,546

(22) Filed: Sep. 10, 2007

(51) Int. Cl.
*A47F 5/08* (2006.01)

(52) U.S. Cl. ..... 211/88.01; 211/73; 229/114; 206/423

(58) Field of Classification Search ..... 211/72, 211/73, 70.1, 87.01, 70.6, 85.26, 189, 88.01; 206/443, 372, 373, 379, 118, 45.24, 423, 206/486; 229/114
See application file for complete search history.

(56) References Cited

U.S. PATENT DOCUMENTS

| | | | | | |
|---|---|---|---|---|---|
| 1,497,456 | A | | 6/1924 | List | |
| 1,901,583 | A | * | 3/1933 | Conway | 206/372 |
| 1,997,310 | A | | 4/1935 | Roege | |
| 2,307,992 | A | | 1/1943 | Calhoun et al. | |
| 2,354,083 | A | * | 7/1944 | Bixby | 206/340 |
| 2,547,716 | A | | 4/1951 | Murphy | |
| 2,654,469 | A | | 10/1953 | Fulmer et al. | |
| 2,659,524 | A | * | 11/1953 | McElwee | 206/193 |
| 2,781,898 | A | | 2/1957 | Desmond et al. | |
| 2,786,621 | A | | 3/1957 | Levkoff | |
| 2,833,457 | A | | 5/1958 | Tyrseck | |
| 2,962,154 | A | * | 11/1960 | Falk | 206/379 |
| 2,990,056 | A | | 6/1961 | Gillam | |
| 3,035,751 | A | | 5/1962 | Brown | |
| 3,115,247 | A | | 12/1963 | Hauser | |
| 3,342,329 | A | | 9/1967 | Knight | |
| 3,379,315 | A | * | 4/1968 | Broadwin | 211/72 |
| 3,754,642 | A | | 8/1973 | Stidolph | 206/752 |
| 3,840,171 | A | | 10/1974 | Waters | 206/562 |
| 3,946,936 | A | * | 3/1976 | Brown | 229/117.18 |
| 3,987,892 | A | | 10/1976 | Killy | 206/563 |
| 4,032,008 | A | * | 6/1977 | Vecchiarelli | 206/379 |
| D245,118 | S | | 7/1977 | Heaton | D24/230 |
| 4,164,287 | A | | 8/1979 | Muller et al. | 211/134 |
| D259,312 | S | * | 5/1981 | Nordlund | D6/569 |
| 4,291,807 | A | * | 9/1981 | Giordano et al. | 229/212 |
| 4,308,986 | A | * | 1/1982 | Parrilli | 206/470 |
| 4,588,095 | A | * | 5/1986 | Mehra | 211/74 |
| 4,863,015 | A | | 9/1989 | Toltzman | 206/756 |
| 4,907,705 | A | | 3/1990 | Waldeck | 211/85.4 |
| 4,949,845 | A | * | 8/1990 | Dixon | 229/212 |
| 5,499,711 | A | * | 3/1996 | Kozak | 206/763 |
| 5,713,472 | A | * | 2/1998 | Howell et al. | 206/784 |

(Continued)

*Primary Examiner*—Darnell M Jayne
*Assistant Examiner*—Andres Gallego
(74) *Attorney, Agent, or Firm*—Francis C. Kowalik; Walgreen Co.

(57) ABSTRACT

The disclosure shows a retail display stand that can be used to display products sold in tapered packages. The display stand has at least one row of upper product apertures and a corresponding row of lower product apertures. The lower product apertures have a lateral dimension that is smaller than the corresponding lateral dimension of the upper product apertures. The stand also has distinct forward and back sets of product apertures. The back apertures have a lateral dimension that is smaller than the corresponding lateral dimension of the forward apertures. The difference in sizing causes tapered packages in the back row to sit in an elevated position with respect to the packages in the forward row of apertures, improving purchaser visibility of the back row of products and creating a better retail display.

11 Claims, 5 Drawing Sheets

U.S. PATENT DOCUMENTS

| | | | | |
|---|---|---|---|---|
| 5,839,649 | A | 11/1998 | Clark | 229/114 |
| 5,979,646 | A | 11/1999 | Strachan et al. | 206/217 |
| 6,431,363 | B1 | 8/2002 | Hacker | 206/765 |
| 6,523,693 | B1 | 2/2003 | Eggenberger et al. | 206/760 |
| 6,523,740 | B2 | 2/2003 | Campbell | 229/114 |
| 6,793,070 | B2 * | 9/2004 | Dye | 206/45.24 |
| 6,920,985 | B2 * | 7/2005 | Chandaria | 211/13.1 |
| 7,007,426 | B1 | 3/2006 | Ohlman, III et al. | 47/84 |
| 7,258,240 | B2 * | 8/2007 | Wescott, III | 211/74 |

* cited by examiner

RETAIL DISPLAY

CROSS-REFERENCE TO RELATED APPLICATIONS

Not applicable.

BACKGROUND OF THE INVENTION

This invention relates generally to retail displays that include a stand that can be used to display products sold in tapered packages, such as chocolate roses.

BRIEF SUMMARY

The applicants have developed a retail display stand that can be used to display products sold in tapered packages, such as chocolate roses. Like one prior known device, the new display stand has at least one row of upper product apertures that are located in an upper section of a base on the display stand, and a corresponding row of lower product apertures that are located in a lower section of the base, beneath the upper product apertures. The lower product apertures have a lateral dimension (for example, width or depth) that is smaller than the corresponding lateral dimension of the upper product apertures, enabling product packages that have a tapering height to be held effectively in the apertures.

Unlike known prior display stands, however, the new display stand has distinct forward and back sets of product apertures. At least one row of back product apertures is located in the base, between a row of forward product apertures and the back on the display stand. Each of the back product apertures has a lateral dimension that is smaller than the corresponding lateral dimension of the forward product apertures. For example, the forward product apertures may have either a width dimension that is smaller than the corresponding width dimension of the forward product apertures, or a depth dimension that is that is smaller than the corresponding depth dimension of the forward product apertures. The difference in sizing of the front and back product apertures causes the product packages in the back row to sit in an elevated position with respect to the packages in the forward row of product apertures, improving purchaser visibility of the back row of products and creating a better retail display.

To facilitate manufacture of the display stand and provide rigidity, cardboard sides on the display stand can, if desired, be made integral with the back. The display stand can also be provided with cardboard flaps that are integral with front edges of lower sections of each of the sides. A lower section of the base can be made of cardboard, integral with and extending perpendicularly to the back. A front section of the base can also be made of cardboard, integral with the lower section of the base, and extending generally parallel to the back. An upper section of the base can also be made of cardboard, integral with the front section, and can extend generally parallel to the lower section of the base and perpendicularly to the back of the stand. Cardboard flaps on the base can also be provided to cooperate with the flaps on the lower sections of the sides, providing rigidity to the base.

The new display stand can also be provided with a cardboard back that is at least 12" high, with tabs near an upper end of the back. When so provided, plastic hangers can be clipped into the tabs on the back to facilitate hanging the display stand.

BRIEF DESCRIPTION OF THE DRAWINGS

The invention may be better understood by referring to the accompanying drawings, in which.

DETAILED DESCRIPTION

Figure 1:
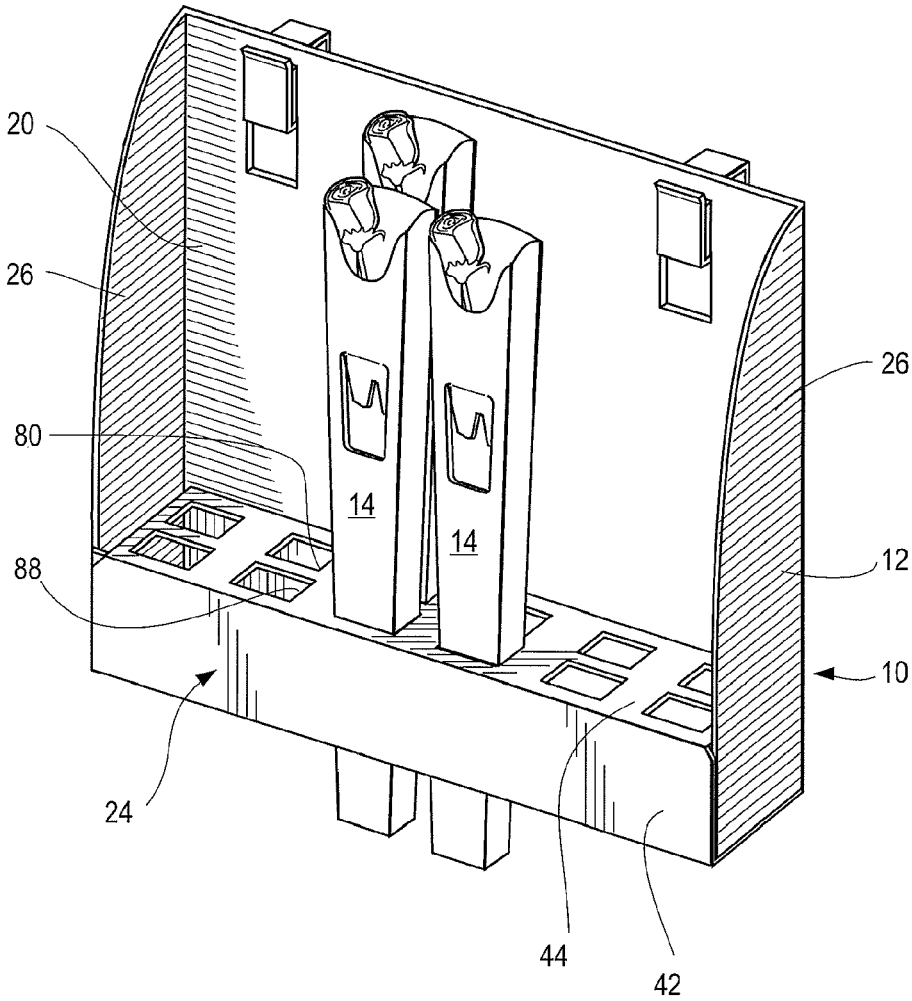
FIG. 1 is a perspective view of a product display.

The retail display 10 seen in FIGS. 1-5 illustrates one embodiment of the invention. The illustrated display includes a display stand 12 and product packages 14.

The Display Stand and its Assembly

The display stand 12 that is illustrated is made principally of folded cardboard, although it could also be made of other materials. The illustrated stand has a cardboard back 20 that extends from a base 24. Sides 26 connect the back and the base.

The back 20 on the illustrated stand 12 is at least 12" high. It has tabs 30 (see FIGS. 2, 6) near an upper end 32 of the back, and plastic hangers 34 that are clipped into the tabs on the back. These hangers provide one way to hang the display stand 12 in a retail environment. For stability, the illustrated hangers are positioned about one foot apart, and about one foot above the top surface of the base 24. The positioning of the hangers could vary. Alternatively, other structure could be used to hang the display from a wall, or, with the addition of a simple lower curtain wall or feet, the display could be arranged to sit on a horizontal surface.

Figure 2:
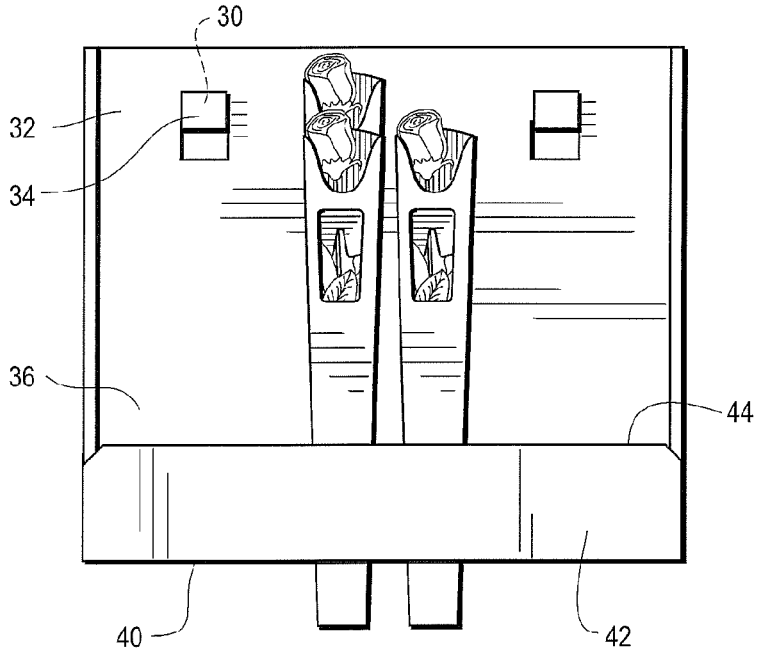
FIGS. 2-5 are front, side, back, and top views of the product display.
Figure 3:
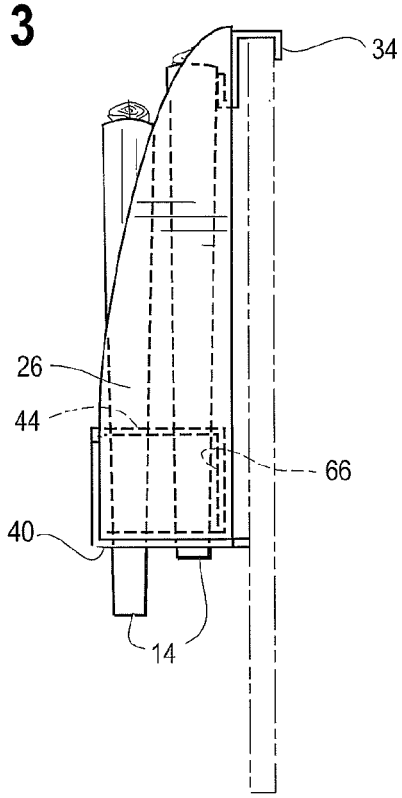
Figure 4:
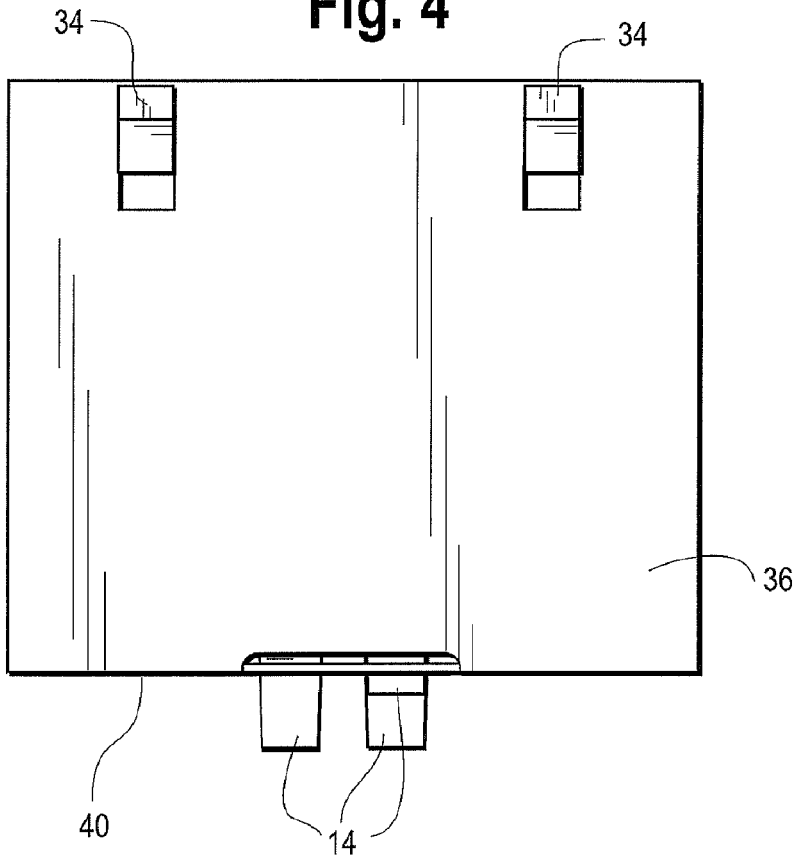
Figure 5:
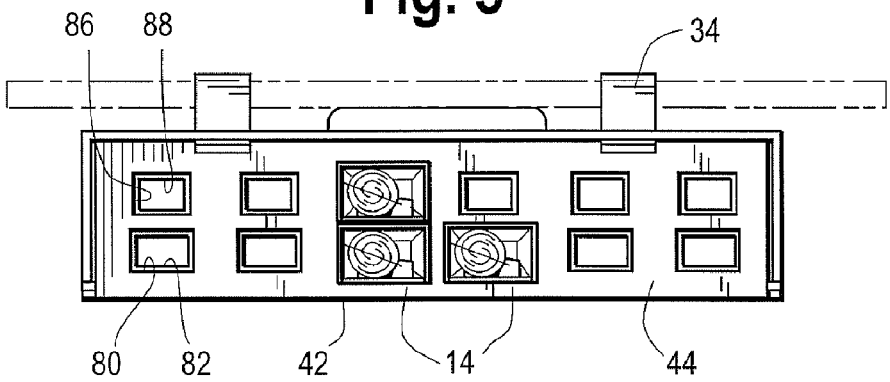

As best seen in FIGS. 2 and 3, the base 24 of the display stand 12 extends from a bottom end 36 of the back 20. The illustrated base is also made of folded cardboard and has a lower section 40, a front section 42, and an upper section 44.

Figure 6:
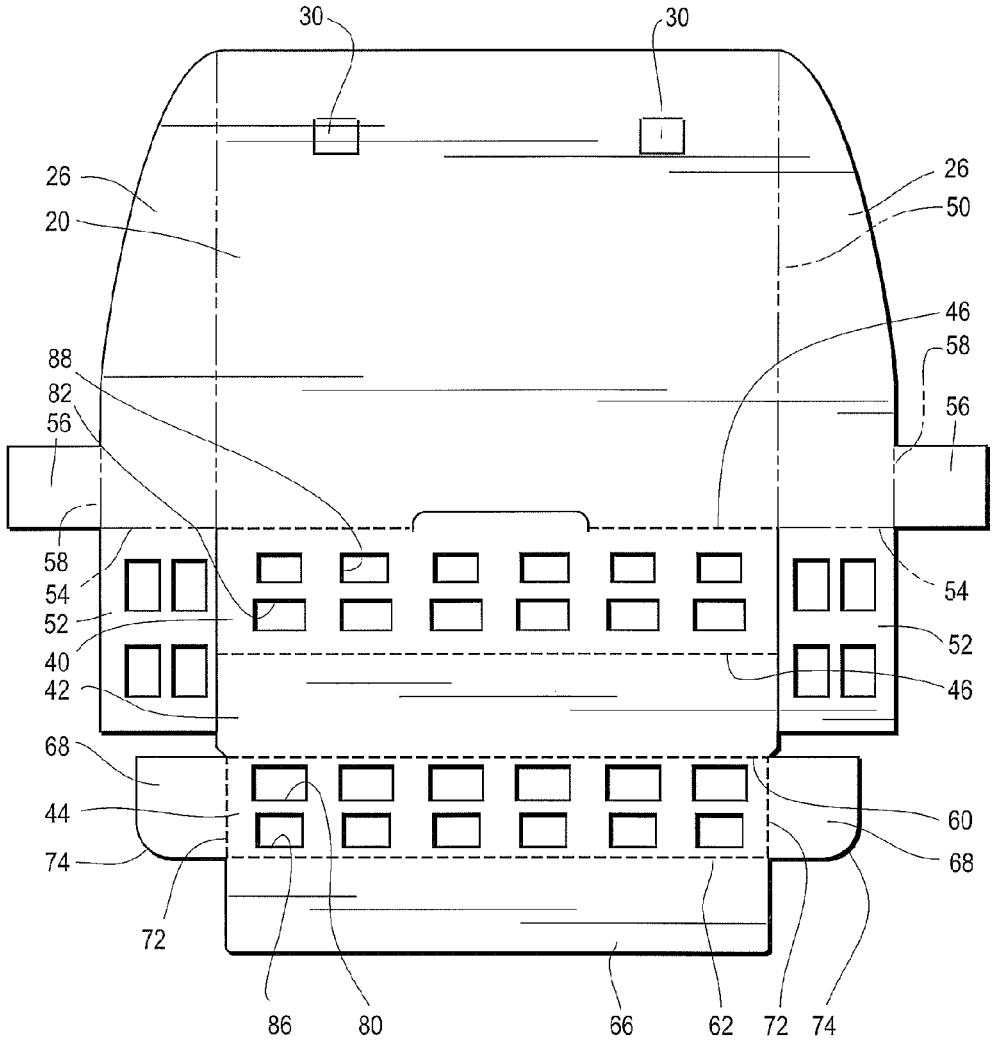
FIG. 6 is a plan view of the display stand in an unfolded condition.
Figure 7:
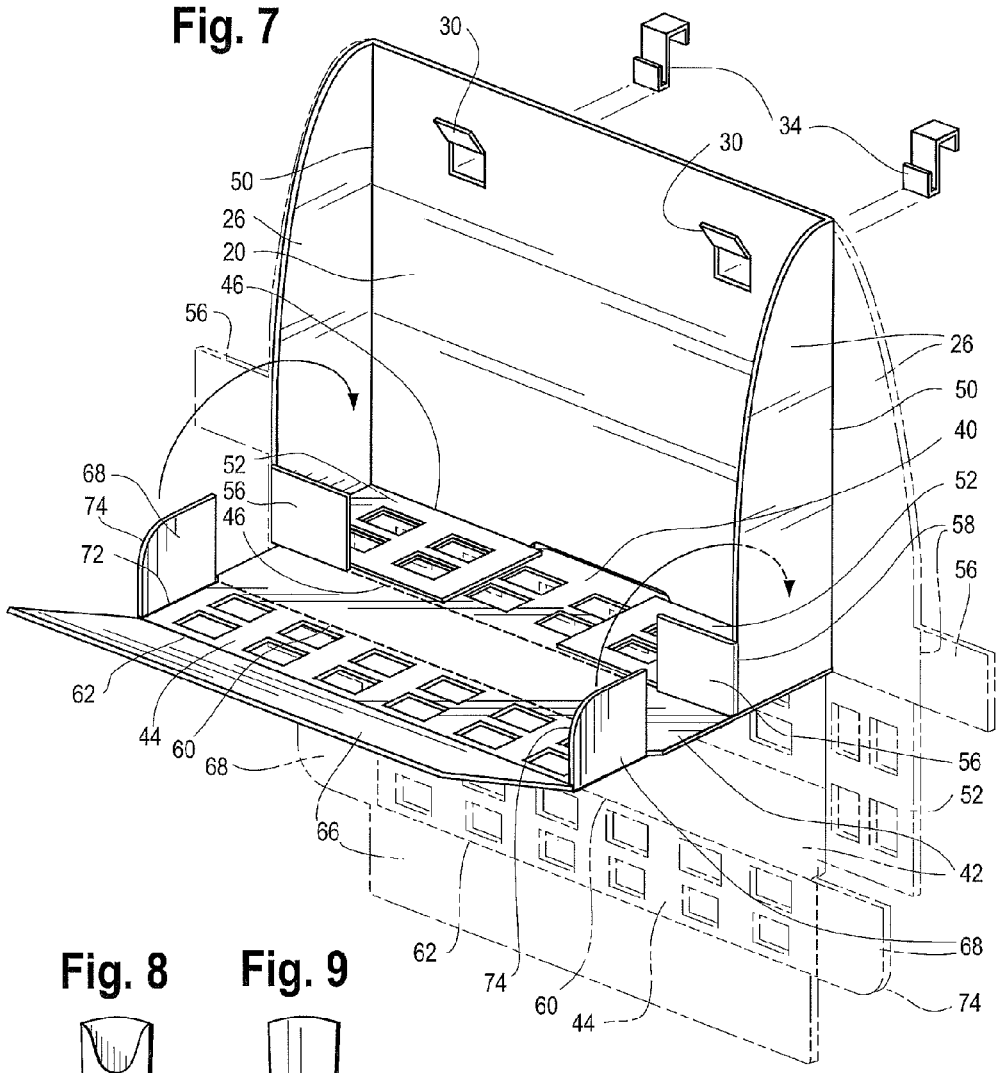
FIG. 7 is a perspective view of the display stand in a partially-folded condition.
Figure 8:
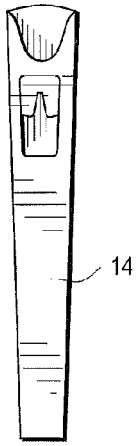
FIGS. 8 and 9 are front and side views of a product package that can be used in the display stand to create the retail display.
Figure 9:
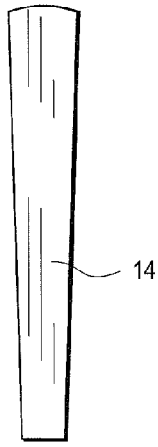

Although the base could be made in other ways, as seen in FIGS. 6 and 7 the illustrated base 24 and the back 20 of the stand are made from a single piece of cardboard. The lower section 40 of the base is folded perpendicularly forward from a lower back fold line 46 at the bottom end 36 of the back. The sides 26 are also folded forward, and lower flaps 52 that extend from a lower flap fold line 54 on a lower section of the sides 26 are positioned against the resulting top surface of the lower section 40 of the base 24.

Front flaps 56 are folded forward from a front flap fold line 58 on lower sections of the sides 26 as the front section 42 is folded perpendicularly upward from a lower forward fold line 60 on a forward part of the lower section 40 of the base 24. This folding operation results in the front section 42 of the base being generally parallel to the back 20 of the base, with the front flaps 56 behind the front section 42. The angle of the front section can be varied as desired. The front section of the illustrated base is about three inches high. When, as here, the displayed packages 14 are no more than about two feet tall and the upper and lower sections of the base extend from the upper and lower edges of front section, for best visibility of the packages it may be preferred that the front section be not more than about six inches high.

The upper section 44 of the base 24 is folded back from an upper forward fold line 60 near the top of the front section 42. As the upper section is being folded back, a rear flap 66 and side flaps 68 can be folded down from an upper back fold line 62 and from side flap fold lines 72 on a rear part and on sides of the upper section 44 of the base. The illustrated side flaps 68 have a curved lower edge 74 that can be folded without interference from the back 20. In the illustrated embodiment of the display stand, this folding operation results in the upper section 44 of the base 24 being generally parallel to the lower section 40 of the base and perpendicular to the back 20 of the stand 12, with the side flaps 68 on the base cooperating with the front flaps 56 on the lower sections of the sides 26 to provide rigidity to the base.

The upper section 44 and the lower section 40 of the base 24 need not be perfectly parallel, but a non-parallel construction may affect the dimensions of the apertures, discussed below.

Packages and their Arrangement in the Display Stand

The illustrated display stand 12 can be used to display products sold in tapered packages, such as chocolate roses. The illustrated packages 14 are made of folded cardboard, and are about 16½ inches tall. Although other sizes can be used, the bottom of the illustrated packages is about 1½ inches wide and about 1 inch deep. At mid-height, the packages are about 2" wide and about 1 3/16 inches deep. The illustrated packages 14 fit in upper and lower apertures on the stand, as explained in more detail below. To accommodate the tapering shape of the packages, the upper apertures are slightly larger than the lower apertures.

At least one row of upper forward product apertures 80 is located in the upper section 44 of the base 24. At least one row of lower forward product apertures 82 are located in the lower section 40 of the base, beneath the upper forward product apertures. Each of the illustrated forward product apertures has a width dimension and a depth dimension. (For conical packages, the apertures might have a common radial dimension.) Each of the lower forward product apertures has a width dimension that is smaller than the corresponding width dimension of the upper forward product apertures and a depth dimension that is that is smaller than the corresponding depth dimension of the upper forward product apertures. In the illustrated embodiment of the invention, for example, the upper forward product apertures 80 are about 1⅞ inches wide and about 1¼ inches deep, and the lower forward product apertures are about 1¾ inches wide and about 1⅛ inches deep. This sizing results in the illustrated packages 14 sitting in the forward apertures so that about 1¾ inches of the packages extend below the lower section 40 of the base, and about 11½ inches of the package is visible above the upper section 44 of the base.

If the upper and lower sections 40, 44 of the base 20 are not parallel, the apparent depth of the apertures can be affected. For example, tilting the upper section so that it rises slightly toward the back one of the base will decrease the apparent depth of the apertures in that section. For determining the efficacy of an arrangement for holding tapered packages, it may be useful to measure the depth of the apertures along parallel planes.

At least one row of upper back product apertures 86 are located in the upper section 44 of the base 24, between the upper forward product apertures 80 and the back 20 of the display stand 12. At least one row of lower back product apertures 88 are located in the lower section 40 of the base, beneath the upper back product apertures 86. Each of the illustrated upper back product apertures 86 has a width dimension that is smaller than the corresponding width dimension of the upper forward product apertures 80 and a depth dimension that is that is smaller than the corresponding depth dimension of the upper forward product apertures. For example, in the illustrated embodiment of the invention, the upper back product apertures are about 1¾ inches wide and about 1⅛ inches deep.

Each of the illustrated lower back product apertures 88 also has a width dimension that is smaller than both the corresponding width dimension of the upper back product apertures 86 and the corresponding width dimension of the lower forward product apertures 82. These lower back product apertures 88 also have a depth dimension that is smaller than both the corresponding depth dimension of the upper back product apertures 86 and the corresponding depth dimension of the lower forward product apertures 82. For example, in the illustrated embodiment of the invention, the lower back product apertures are about 1½ inches wide and about 1 1/16 inches deep.

This sizing of the back apertures 86, 88 causes tapered packages 14 held in those apertures to be held in an elevated position with respect to packages in the forward product apertures 80, 82. In particular, packages sitting in the illustrated back apertures have about ¾ inch of the package extending below the lower section 40 of the base, and about 12½ inches of the package visible above the upper section 44 of the base, resulting in packages in the back apertures sitting about 1" higher than the packages in the front apertures. This arrangement results in an attractive, functional display.

This description of various embodiments of the invention has been provided for illustrative purposes. Revisions or modifications may be apparent to those of ordinary skill in the art without departing from the invention. The full scope of the invention is set forth in the following claims.

The invention claimed is:

1. A retail display comprising:

(a) a display stand that has:

a cardboard back that is at least 12" high and has tabs near an upper end of the back;

plastic hangers that are clipped into the tabs on the back;

cardboard sides that are integral with the back;

first cardboard flaps that are integral with front edges of lower sections of each of the sides;

a base that extends from a bottom end of the back;

a lower section of the base that is made of cardboard and is integral with and extends perpendicularly to the back;

a front section of the base that is made of cardboard, is integral with the lower section of the base, extends generally parallel to the back, and is no more than about 6" high;

an upper section of the base that is made of cardboard, is integral with the front section, extends generally parallel to the lower section of the base and perpendicularly to the back of the stand, and has a back edge adjacent the back of the stand;

second cardboard flaps on the base that cooperate with the first cardboard flaps on the lower sections of the sides, providing rigidity to the base;

at least one row of upper forward product apertures that are located in the upper section of the base and each have a width dimension and a depth dimension;

at least one row of lower forward product apertures that are located in the lower section of the base, beneath the upper forward product apertures, and each have a width dimension that is smaller than the corresponding width dimension of the upper forward product apertures and a depth dimension that is smaller than the corresponding depth dimension of the upper forward product apertures;

at least one row of upper back product apertures that are located in the upper section of the base, between the upper forward product apertures and the back, and each have a width dimension that is smaller than the corresponding width dimension of the upper forward product apertures and a depth dimension that is smaller than the corresponding depth dimension of the upper forward product apertures; and at least one row of lower back product apertures that are located in the lower section of the base, beneath the upper back product apertures, and each have a width dimension that is smaller than the corresponding width dimension of the upper back product apertures and a depth dimension that is smaller than the corresponding depth dimension of the upper back product apertures; and (b) a plurality of similarly sized product packages that have a tapering height and are each positioned in a set of the upper and lower product apertures, the packages in the back product apertures being held in an elevated position with respect to similarly disposed packages in the forward product apertures.

2. A retail display that has:

(a) a display stand that has:

a back;

a base that extends from a lower portion of the back and has an upper section and a lower section;

at least one row of upper forward product apertures that are located in the upper section of the base and each have a lateral dimension;

at least one row of lower forward product apertures that are located in the lower section of the base, beneath the upper forward product apertures, and each have a lateral dimension that is smaller than the corresponding lateral dimension of the upper forward product apertures;

at least one row of upper back product apertures that are located in the upper section of the base, between the upper forward product apertures and the back, and each have a lateral dimension that is smaller than the corresponding lateral dimension of the upper forward product apertures; and at least one row of lower back product apertures that are located in the lower section of the base, beneath the upper back product apertures, and each have a lateral dimension that is smaller than the corresponding lateral dimension of the upper back product apertures; and (b) a plurality of packaged products that have a tapering height and are each positioned in a set of upper and lower product apertures, products in the back product apertures being held in an elevated position with respect to the packages in the forward product apertures.

3. The retail display as recited in claim 2, in which:

the back is made of cardboard, is at least 12" high, and has tabs near an upper end of the back; and the display stand has plastic hangers that are clipped into the tabs on the back.

4. The retail display as recited in claim 2, in which the display stand has:

first cardboard flaps that are integral with front edges of lower sections of each of the sides;

the base that extends from a bottom end of the back;

the lower section of the base that is made of cardboard and is integral with and extends perpendicularly to the back;

a front section of the base that is made of cardboard, is integral with the lower section of the base, extends generally parallel to the back, and is no more than about 6" high;

the upper section of the base that is made of cardboard, is integral with the front section, extends generally parallel to the lower section of the base and perpendicularly to the back of the stand, and has a back edge adjacent the back of the stand; and second cardboard flaps on the base that cooperate with the first cardboard flaps on the lower sections of the sides, providing rigidity to the base.

5. The retail display as recited in claim 2, in which:

at least some of the lower product apertures have a width dimension that is smaller than a corresponding lateral dimension of the corresponding upper product apertures.

6. The retail display recited in claim 2, in which:

at least some of the lower product apertures have a lateral depth dimension that is smaller than a corresponding lateral depth dimension of the corresponding upper product apertures.

7. The retail display as recited in claim 2, in which:

at least some of the back product apertures have a width dimension that is smaller than a corresponding lateral dimension of the corresponding forward product apertures.

8. The retail display as recited in claim 2, in which:

at least some of the back product apertures have a lateral depth dimension that is smaller than a corresponding lateral depth dimension of the corresponding forward product apertures.

9. The retail display as recited in claim 2, in which:

at least some of the lower product apertures have a lateral width dimension that is smaller than a corresponding lateral width dimension of the corresponding upper product apertures, and a lateral depth dimension that is smaller than a corresponding lateral depth dimension of the corresponding upper product apertures.

10. The retail display as recited in claim 2, in which:

at least some of the back product apertures have a lateral width dimension that is smaller than a corresponding lateral width dimension of the corresponding forward product apertures, and a lateral depth dimension that is smaller than a corresponding lateral depth dimension of the corresponding forward product apertures.

11. The retail display as recited in claim 2, in which:

at least some of the lower product apertures have a lateral width dimension that is smaller than a corresponding lateral width dimension of the corresponding upper product apertures, and a lateral depth dimension that is smaller than a corresponding lateral depth dimension of the corresponding upper product apertures; and at least some of the back product apertures have a lateral width dimension that is smaller than a corresponding width dimension of the corresponding forward product apertures, and a lateral depth dimension that is smaller than a corresponding lateral depth dimension of the corresponding forward product apertures.

* * * * *